US007889091B2

(12) United States Patent
Goon

(10) Patent No.: US 7,889,091 B2
(45) Date of Patent: Feb. 15, 2011

(54) EMERGENCY DEVICE ACTUATOR ABSENCE NOTIFICATION SYSTEM AND METHOD THEREFOR

(76) Inventor: Ron Goon, 3426 E. Woodland Dr., Phoenix, AZ (US) 85048

( * ) Notice: Subject to any disclaimer, the term of this patent is extended or adjusted under 35 U.S.C. 154(b) by 328 days.

(21) Appl. No.: 12/243,725

(22) Filed: Oct. 1, 2008

(65) Prior Publication Data

US 2010/0079295 A1 Apr. 1, 2010

(51) Int. Cl.
*G08B 21/00* (2006.01)

(52) U.S. Cl. ..... 340/687; 340/644; 340/652; 340/686.1

(58) Field of Classification Search ..... 340/687, 340/628, 507, 524, 531, 532, 635, 638, 644, 340/650, 652, 653, 686.1; 361/115
See application file for complete search history.

(56) References Cited

U.S. PATENT DOCUMENTS 4,045,714 A 8/1977 MacLeod
4,064,508 A 12/1977 Simon
4,127,847 A 11/1978 Stifter
4,645,886 A * 2/1987 Williams ..... 200/1 R
5,199,118 A 4/1993 Cole et al.
5,574,436 A * 11/1996 Sisselman et al. ..... 340/663
5,600,300 A 2/1997 Povilaitis
6,480,109 B1 11/2002 Tice
7,049,951 B2 5/2006 Rhodes et al.

* cited by examiner

*Primary Examiner*—Toan N Pham
(74) *Attorney, Agent, or Firm*—Jeffrey D. Moy; Weiss & Moy, P.C.

(57) ABSTRACT

An emergency device actuator absence notification system and method therefore capable of notifying an observer or system supervisor of the presence and operability of the emergency device actuator and also capable of notifying an observer or system supervisor of the absence or inoperability of the emergency device actuator.

8 Claims, 3 Drawing Sheets

EMERGENCY DEVICE ACTUATOR ABSENCE NOTIFICATION SYSTEM AND METHOD THEREFOR

FIELD OF THE INVENTION

This invention relates generally to fire prevention and, more specifically, to an emergency device actuator absence notification system capable of detecting when a fire prevention relay device, commonly referred to as an actuator, such as a solenoid for triggering a sprinkler system or other fire extinguishing mechanism, is removed or disconnected from the system and thereafter warning those monitoring the system of the absence of the actuator, and also capable of communicating the presence and operability of the aforementioned actuator to those monitoring the system.

BACKGROUND OF THE INVENTION

It is often the case that warning devices designed to notify a person of an emergency, or even designed to address the emergency situation itself, are not equipped with any means for notifying an individual of when the actuator used to address an emergency is removed or inoperable, as in the case of maintenance.

This invention addresses this problem by providing a supervisory switch contained within an emergency device actuator absence notification system that is capable of detecting the presence or absence of the emergency device actuator, and is capable of transmitting differing signals representing the presence or absence of the actuating device.

SUMMARY OF THE INVENTION

An object of the present invention is to provide an emergency device actuator absence notification system combined with an actuator of a fire prevention system or other emergency prevention system having the ability to notify users of the presence or absence of the actuator.

BRIEF DESCRIPTION OF THE PREFERRED EMBODIMENTS

An emergency device actuator absence notification system is disclosed, comprising a rigid planar member, a transducer housing coupled to the planar member, and a transducer located within the transducer housing. The device further comprises a pair of electrical contact points located on the transducer, a lever having a first end coupled to the transducer within the transducer housing and passing through a lever opening in the transducer housing causing the lever to have a second end external to the transducer housing, the lever having electrically conductive and flexible properties causing the lever to rest in a first position when the lever has no external forces acting upon it, and being so positioned as to become in contact with both of the electrical contact points when the lever is depressed and caused to be in a second position, thereby causing the electrical contact points to become in electrical contact with one another. The transducer is capable of emitting a plurality of signals depending upon a state of the transducer, the state of the transducer being dependent upon one of the existence and nonexistence of electrical contact between the electrical contact points, which is in turn dependent upon a position of the lever, and electrical leads having first ends coupled to the transducer and capable of transmitting the plurality of signals from the transducer, the electrical leads passing through an electrical lead opening in the transducer housing and having second ends external to the transducer housing.

Also disclosed is a method of monitoring the presence and absence of an emergency device actuator comprising producing a signal indicating the presence of the emergency device actuator when the emergency device actuator is so situated with respect to an emergency device actuator absence notification system when the emergency device actuator is in use and in contact with the emergency device actuator absence notification system, and producing a signal from the emergency device actuator absence notification system indicating an absence of the emergency device actuator when the emergency device actuator is no longer in contact with the emergency device actuator absence notification system.

DETAILED DESCRIPTION OF THE PREFERRED EMBODIMENTS

Figure 1:
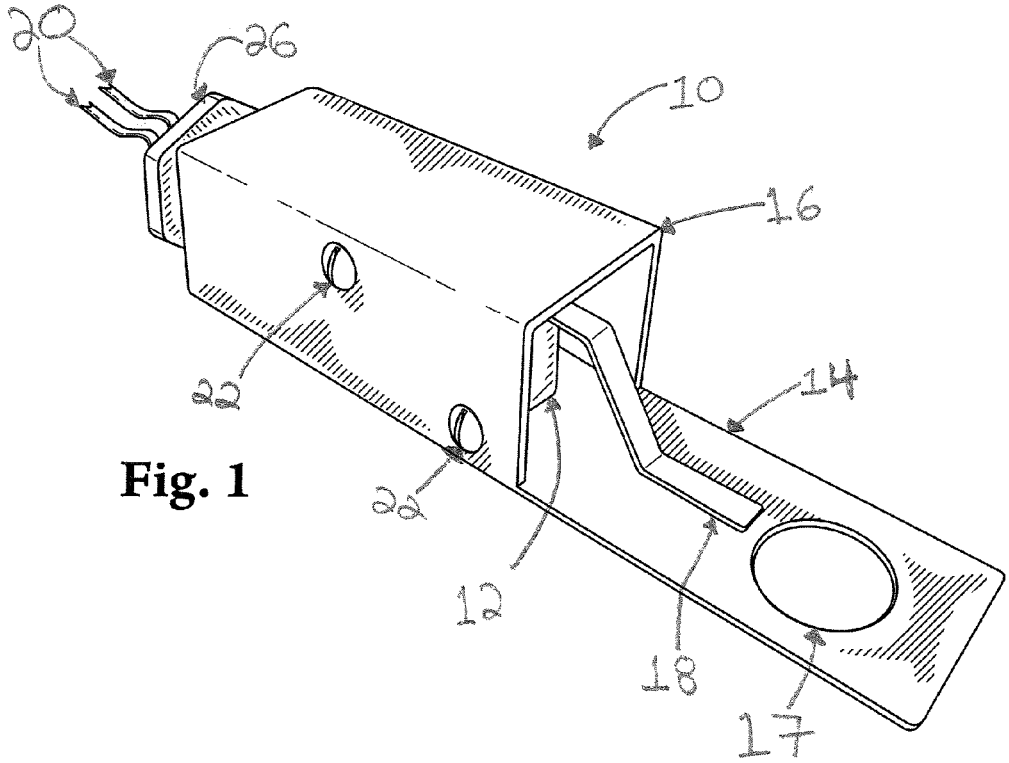
FIG. 1 is an elevated perspective view of an emergency device actuator absence notification system of the present invention.

The invention will best be understood by reference to the following detailed description of illustrated embodiments when read in conjunction with the accompanying drawings, wherein like reference numerals and symbols represent like elements.

Referring to FIGS. 1-6, an embodiment of an emergency device actuator absence notification system 10, referred to generically as an emergency device actuator absence notification system 10, is disclosed. The emergency device actuator absence notification system 10 comprises a transducer 12 (shown in FIGS. 5 and 6 and partially shown in FIG. 1). The transducer 12 rests upon a flat planar member 14 and housed within a transducer housing 16. The transducer 12 is held securely by a pair of fastening mechanisms 22 (shown in FIGS. 1 and 3-6) coupled to the transducer housing 16 as well as coupled to the transducer 12. The transducer 12 is coupled to a lever 18 (shown in FIGS. 1 and 3-6) and to a pair of electrical leads 20, the lever 18 and the electrical leads 20 being both partially housed within the transducer housing 16.

Figure 5:
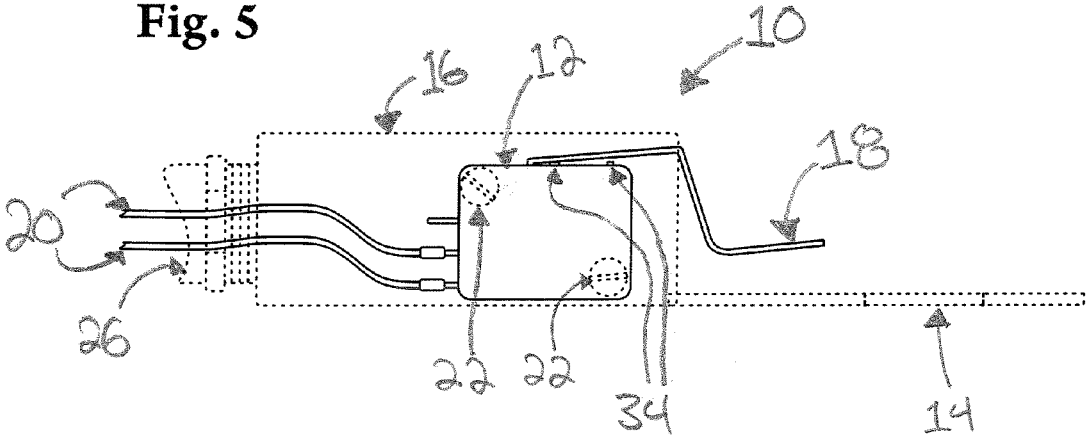
FIG. 5 is a side view of the emergency device actuator absence notification system with the transducer housing made transparent and represented by dotted lines to show the features of the transducer contained within the transducer housing, and with the lever coupled to the transducer in its upward position, corresponding to a "system offline" signal across the electrical leads.
Figure 6:
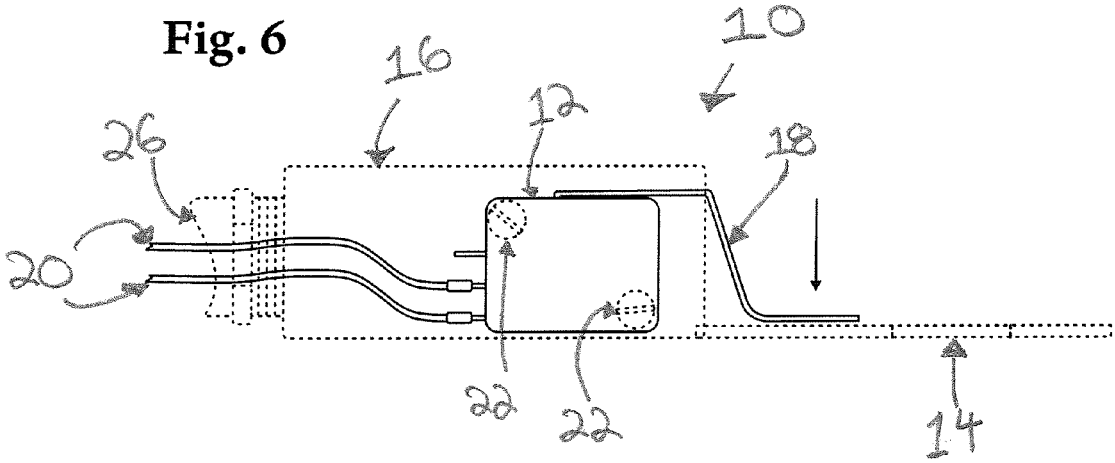
FIG. 6 is a side view of the emergency device actuator absence notification system with the transducer housing made transparent and represented by dotted lines to show the features of the transducer contained within the transducer housing, and with the lever coupled to the transducer in its downward position, corresponding to a "system ready" signal across the electrical leads.

Referring to FIGS. 5 and 6, the transducer 12 has a pair of electrical contact points 34. The contact points 34 are positioned in relation to the lever 18 so that when the lever 18 is in its downward position the lever 18 causes the electrical contact points 34 to be in electrical contact with one another via the lever 18. Accordingly, the lever 18 is made of a sufficiently electrically conductive and flexible material and is so connected to the transducer 12 so that when no force acts upon the lever 18, the lever 18 remains in an upward position and does not form an electrical connection between the pair of electrical contact points 34, the lever 18 being capable of becoming in contact with both electrical contact points 34 when a sufficient downward force is applied to it.

Figure 2:
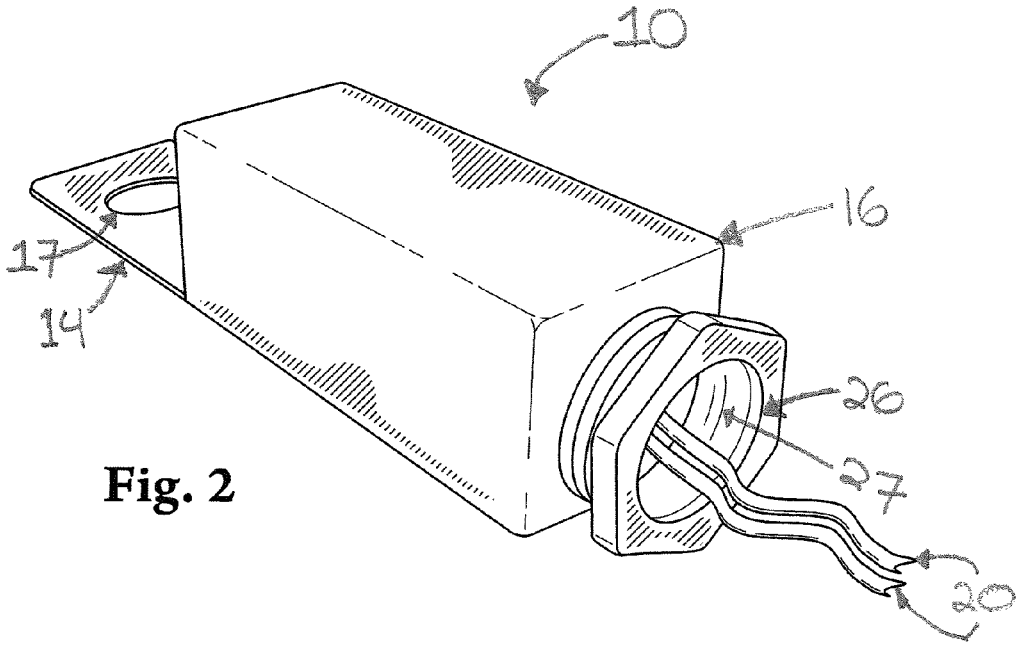
FIG. 2 is an elevated perspective view of the emergency device actuator absence notification system taken from a second angled position.
Figure 3:
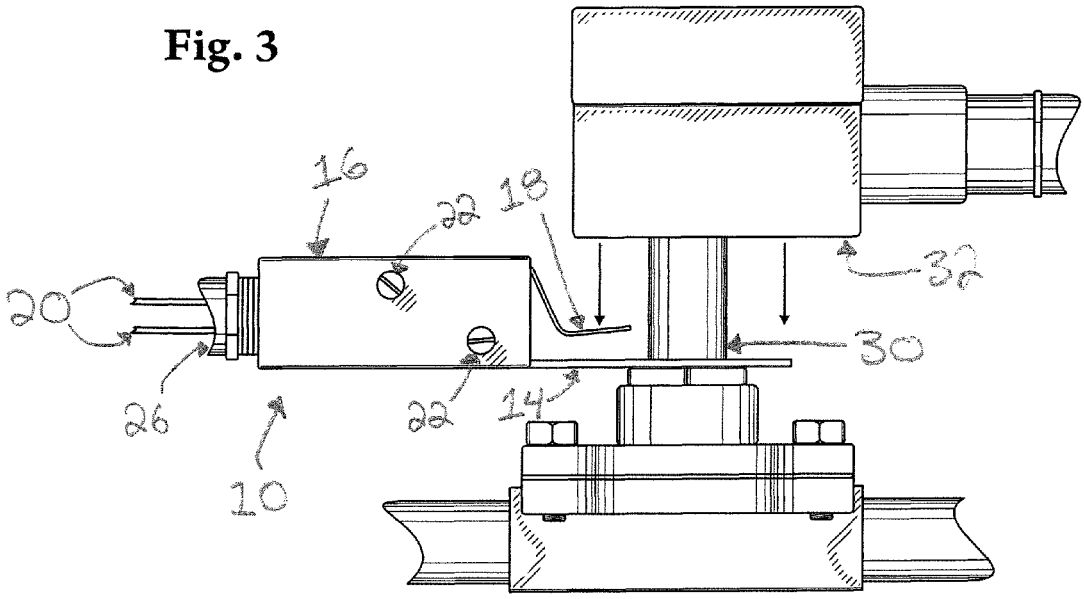
FIG. 3 is a side perspective view of the emergency device actuator absence notification system in its working environment, with an actuator shown just prior to being placed upon the lever.

Referring to FIGS. 1-3, the electrical leads 20 are also both partially exposed through an electrical lead opening 26 in the transducer housing 16. In accordance with one embodiment, the electrical lead opening 26 may having threading 27 to enable coupling with a wire housing or other structure (not shown) Also present in the planar member 14 is a hole 17 (shown in FIGS. 1 and 2) beyond the edge of the range of motion of the lever 18 for placement about a post 30 (shown in FIG. 3) when the emergency device actuator absence notification system 10 is in its working environment.

Figure 4:
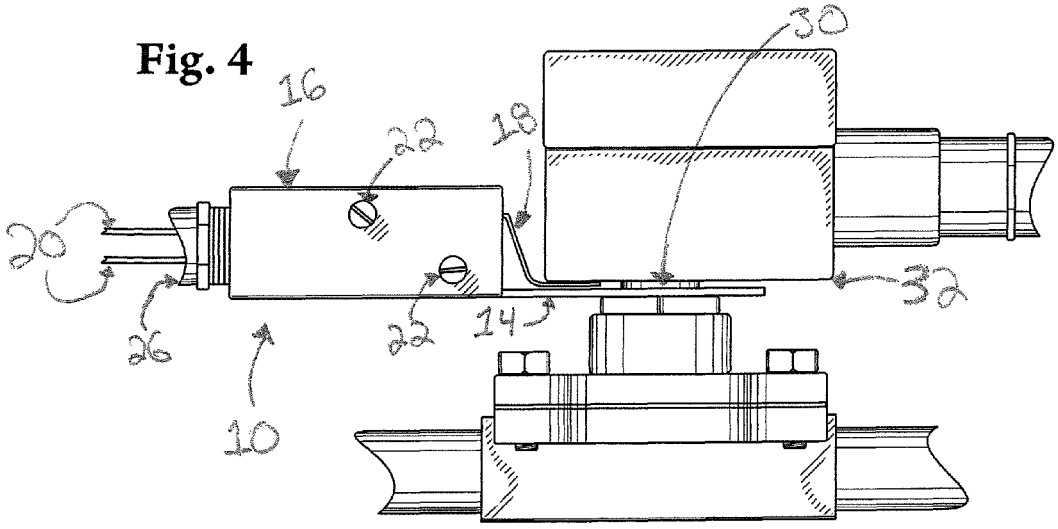
FIG. 4 is a side perspective view of the emergency device actuator absence notification system in its working environment, with the actuator shown in its resting and working position, resting upon the lever.

Referring to FIGS. 3 and 4 the present embodiment of an emergency device actuator absence notification system 10 is shown in a typical working environment, and the interaction of the emergency device actuator absence notification system 10 with an emergency device actuator 32 is shown. When the emergency device actuator 32 is in its working position (shown in FIG. 4), the emergency device actuator 32 is situated so that it is also placed about the same post 30 that passes through the hole 17 of the emergency device actuator absence notification system 10. This causes the emergency device actuator 32 to slide down the post 30 and to rest on the lever 18 and the planar member 14, thereby causing the depression of the lever 18. The depression of the lever 18 causes the lever 18 to form an electrical connection with the two electrical contact points 34 (shown in FIGS. 5 and 6) and thereby causes the transducer to produce a "system ready" signal across its electrical leads 20. When the emergency device actuator 32 is removed from its working position (shown in FIG. 3), the inherent characteristics of the lever 18 and its connection to the transducer 12 causes the lever 18 to rest in its upward position, whereby the electrical contact points 34 are not in electrical contact with one another, thereby causing the transducer to produce a "system offline" signal across its electrical leads 20.

Referring now to FIG. 6, a transparent view of the transducer housing 16, the electrical lead opening 26, and the rigid planar member 14 is shown. FIG. 6 shows the details of the transducer 12 and the lever 18 with the lever 18 shown in its downward position. In the downward position, the lever 18 corresponds to the state of the emergency device actuator absence notification system 10 as it is shown in FIG. 4, whereby the lever 18 creates electrical contact between the electrical contact points 34. The connection of both contact points 34 by the lever 18 causes the transducer 12 to produce a "system ready" signal across the electrical leads 20.

Referring now to FIG. 5, a transparent view of the transducer housing 16, the electrical lead opening 26, and the rigid planar member 14 is shown. FIG. 5 shows the details of the transducer 12 and the lever 18 with the lever 18 shown in its upward position. In the upward position, the lever 18 corresponds to the state of the emergency device actuator absence notification system 10 as it is shown in FIG. 3, whereby the lever 18 causes the electrical contact points 34 to be electrically insulated from one another, thereby causing the transducer 12 to produce a "system offline" signal across its electrical leads 20.

While the invention has been particularly shown and described with reference to preferred embodiments thereof, it will be understood by those skilled in the art that the foregoing and other changes in form and details may be made therein without departing from the spirit and scope of the invention.

I claim:

1. An emergency device actuator absence notification system comprising:

a rigid planar member;

a transducer housing coupled to said planar member;

a transducer located within said transducer housing and coupled to said planar member, said transducer having a pair of electrical contact points located on said transducer;

a lever having a first end coupled to said transducer within said transducer housing and passing through a lever opening in said transducer housing causing said lever to have a second end external to said transducer housing, said lever having electrically conductive and flexible properties causing said lever to rest in a first position when said lever has no external forces acting upon it, and being so positioned as to become in contact with both of said electrical contact points when said lever is depressed and caused to be in a second position, thereby causing the electrical contact points to become in electrical contact with one another;

wherein said transducer being capable of emitting a plurality of signals depending upon a state of said transducer, said state of said transducer being dependent upon one of the existence and nonexistence of electrical contact between said electrical contact points, which is in turn dependent upon said lever being in one of said first position and said second position;

electrical leads having first ends coupled to said transducer and capable of transmitting said plurality of signals from said transducer; and an electrical lead opening formed in said transducer housing, said electrical leads passing through said electrical lead opening.

2. The emergency device actuator absence notification system of claim 1 further comprising a circular opening through said rigid planar member located in close proximity to said lever when said lever is in said second position, and so positioned that a range of motion of said lever will not be impeded by placing the device about a post having approximately a same diameter of said circular opening.

3. The emergency device actuator absence notification system of claim 1 wherein said electrical lead opening is a threaded opening enabling coupling with a wire housing.

4. A method of monitoring a presence and absence of an emergency device actuator comprising producing a signal indicating the presence of said emergency device actuator when said emergency device actuator is so situated with respect to an emergency device actuator absence notification system when said emergency device actuator is in use and in contact with said emergency device actuator absence notification system; and producing a signal from said emergency device actuator absence notification system indicating an absence of said emergency device actuator when said emergency device actuator is no longer in contact with said emergency device actuator absence notification system.

5. An emergency device actuator absence notification system comprising:

a planar base member;

a housing coupled to said planar base member;

a transducer located within said transducer housing and attached to said planar base member, said transducer having a pair of electrical contact points located on said transducer; and a lever having a first end coupled to said transducer and a second end extending out through said housing, said lever having a first position forming an open circuit between said pair of electrical contacts and a second position forming an electrical connection between said electrical contact points when said lever is depressed;

wherein said transducer sends a first signal when said lever is in said first position to indicate an absence of an actuator device and a second signal when said lever is in said second position to indicate a presence of said actuator device.

6. The emergency device actuator absence notification system of claim 5 further comprising a circular opening formed through said planar base member.

7. The emergency device actuator absence notification system of claim 5 further comprising an electrical lead opening formed in the housing.

8. The emergency device actuator absence notification system of claim 7 wherein said electrical lead opening is a threaded opening enabling coupling with a wire housing.

* * * * *